United States Patent [19]

Wismer

[11] 4,425,020

[45] Jan. 10, 1984

[54] CLAMP FOR AN ELECTROPLATING RACK

[76] Inventor: Joseph C. Wismer, 10 Sussex Rd., Bergenfield, N.J. 07621

[21] Appl. No.: 391,856

[22] Filed: Jun. 24, 1982

[51] Int. Cl.[3] ..... H01R 4/36

[52] U.S. Cl. ..... 339/264 R

[58] Field of Search ..... 339/108 R, 109, 110, 339/114–116, 202, 263, 264

[56] References Cited

U.S. PATENT DOCUMENTS 4,176,039 11/1979 Wismer ..... 339/263 E 4,215,908 8/1980 Cherry et al. ..... 339/264 R

*Primary Examiner*—Joseph H. McGlynn

*Assistant Examiner*—David L. Pirlot

*Attorney, Agent, or Firm*—Staas & Halsey

[57] ABSTRACT

A clamp for securing and electrically connecting an object to be electroplated to an electroplating rack for immersion in an electroplating solution, electrical contact being made between the rack and the object. The clamp includes a frame including a conductive core and an insulating sheath thereover. An opening in the frame has a threaded electrically conductive portion and at least one unthreaded electrically insulating end portion. A clamp screw is provided, having an actuating head, a clamp face, and a threaded central electrically conductive shank portion intermediate the clamp face and actuating head and spaced therefrom and adapted to engage the threaded electrically conductive portion of the frame opening. The screw has at least one shank portion contiguous with and flanking the central portion which is unthreaded, the unthreaded shank portion and the unthreaded end portion of the frame opening being dimensioned for a surface-to-surface substantially liquid-tight interference fit, to provide therebetween a relatively liquid-tight seal, whereby significant quantities of electroplating solution is prevented from reaching the threaded electrically conductive shank and frame portions, the clamp face including a conductive face portion for contacting the item to be electroplated. The conductive portion of the clamp face is internally conductively connected with the threaded screw shank portion. A conductive clamp pad is provided flush with the outer insulating sheath of the frame and opposite the clamp face of the screw between which the object to be electrically engaged and clamped is positioned.

20 Claims, 6 Drawing Figures

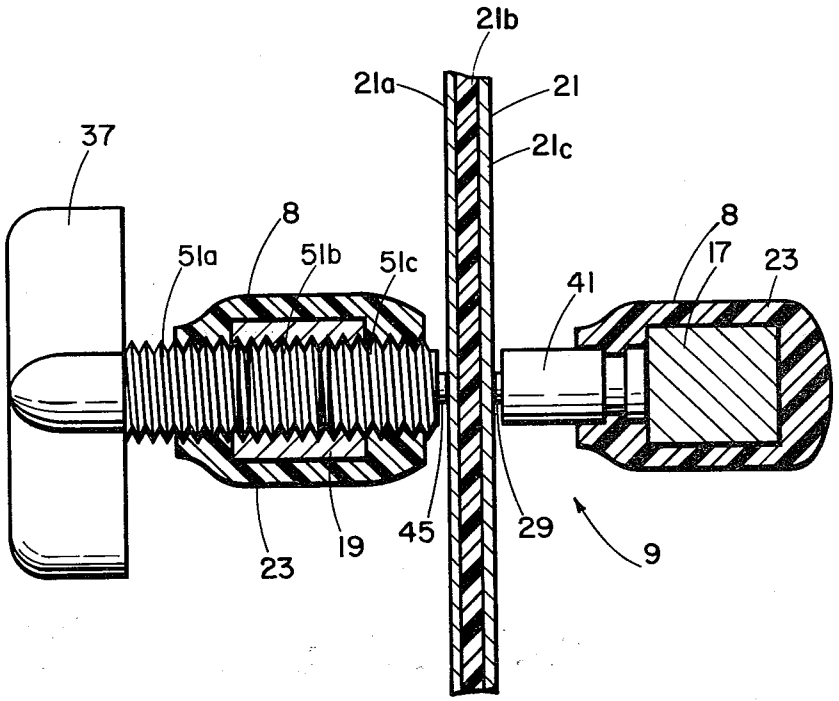
PRIOR ART Fig. 2A
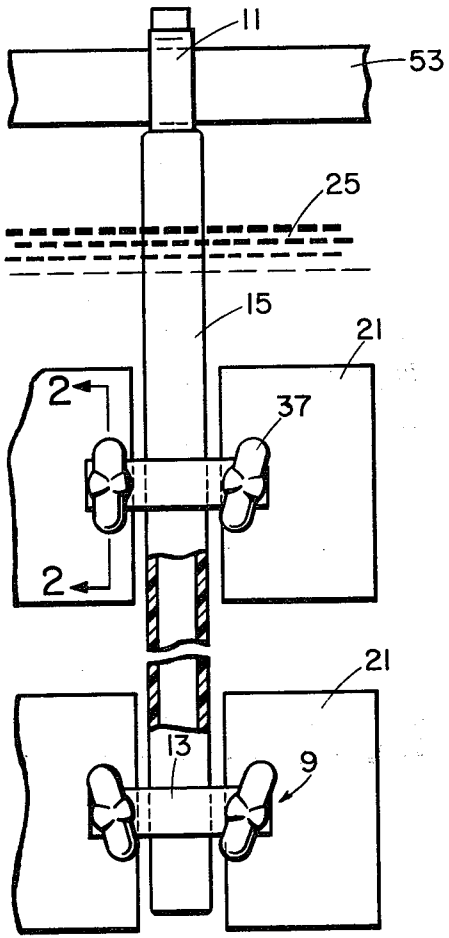
PRIOR ART Fig. 1

CLAMP FOR AN ELECTROPLATING RACK

BACKGROUND OF THE INVENTION

1. Field of the Invention

The invention relates generally to electroplating apparatus, and more specifically to a clamp for securing and electrically connecting an object to be electroplated to an electroplating rack for immersion in an electroplating solution.

2. Prior Art

In the inventor's prior U.S. Pat. No. 4,176,039, an electroplating rack is disclosed utilizing a clamp having a clamp screw and an opposing clamp pad, both the clamp screw and clamp having a structure which provides the appropriate clamping forces and electrical connections to an object to be electroplated, while establishing seals for isolating the electrically conductive elements of the clamp from the plating solution. As will be further discussed in connection with prior art FIGS. 1 and 2, the present invention is an improvement over the structure of the clamp disclosed in the inventor's U.S. Pat. No. 4,176,039 patent as shown in FIG. 2A and the structure of the clamp developed by the inventor as shown in FIG. 2B. The clamp developed by the inventor as shown in FIG. 2B includes a clamp screw, the shank of which has a threaded electrically conductive central portion and electrically insulating unthreaded portions which are contiguously joined to the front and rear of the conductive portion. The central conductive threaded portion of the shank engages a central metallic portion of a threaded opening in the clamp frame and makes electrical contact therewith. The forwardly extended unthreaded shank portion of the clamp screw engages another non-metallic (insulating) threaded portion of the opening of the clamp frame, with the distal end of the conductive screw portion being exposed for electrically and mechanically contacting the clamp workpiece. The rearwardly extended unthreaded shank portion of the clamp screw extends axially between the central metallic conductive threaded portion and the handle of the clamp; this portion engages another non-metallic (insulating) threaded portion of the opening of the clamp frame. Since the frame is covered with insulating material, the only electrical contact between the object to be plated and the frame is through the clamp screw and opposing clamp pad. The central portion of the clamp screw is electrically accessible—the end portions of the screw as aforementioned are covered with insulating material, which is to shield the screw's metal skeleton from plate build-up and chemical attack of solution, while simultaneously isolating the engaged central metallic threaded portion from the plating solution to also prevent jamming from plate build-up and reduced chemical attack thereof.

The aforementioned clamp screw was found, however, not to provide as satisfactory a sealing action as desired because the threads in both the forward and rearward portions 8*c* and 8*a*, respectively, of the clamp frame were unfilled by the unthreaded portions 7*a* and 7*c* of the clamp screw—compression notwithstanding. A pathway for the plating solution to enter the system was thereby provided; and, as a result, plate build-up occurred on both the electrically conductive threaded portion 7*b* of the clamp screw and the electrically conductive threaded opening 19 in the clamp frame.

The clamp disclosed in the inventor's U.S. Pat. No. 4,176,039 and as shown in FIG. 2A includes a clamp screw, the threaded shank of which, while including a conductive core, is externally of a tripartite construction. In particular, the axially extending shank of this prior art screw includes a threaded electrically conductive central portion and resilient, electrically insulating threaded portions which are contiguously adjoined to the front and rear of the said conductive portion. The central conductive threaded portion of the shank engages a central metallic portion of a threaded opening in the clamp frame and makes electrical contact therewith. The forward threaded shank portion (of insulating material) engages another non-metallic (insulating) portion of a threaded opening of the clamp frame, with the distal end of the conductive core being exposed for electrically and mechanically contacting the clamped workpiece. The rearwardly extending threaded portion (of insulating material) extends axially between the central metallic conductive threaded portion and the handle of the screw; this portion engages the other non-metallic insulating portion of the threaded opening of the clamp frame. Since the frame is covered with insulating material, the only electrical contact between the object to be plated and the frame is through the threaded screw, the central portion of which is electrically accessible—the end threaded portions of the screw as aforementioned are covered with insulating material, which shields the screw's metal skeleton from plate build-up and chemical attack of solution, while simultaneously isolating the engaged central metallic threaded portion from the plating solution to also prevent jamming from plate build-up and reduce chemical attack thereof.

The aforementioned tripartite screw is of subtle and precise construction, and while it is more efficacious in sealing the central threaded conductive portion from electrolyte than the one depicted in FIG. 2B, it is difficult and expensive to fabricate and repair.

SUMMARY OF THE INVENTION

In accordance with the present invention, it has unexpectedly been found that a clamp can be achieved having superior sealing and shielding characteristics than that depicted in FIG. 2B, approximating, if not surpassing that of my prior art clamp, defined in U.S. Pat. No. 4,176,039 and which can be achieved in a simple and low cost construction. According to the invention, instead of threading the forward and rearward portions of the screw shank, I provide at at least one of said portions a simple sleeve or cylindrical covering of electrically insulating material, which sealingly engages with an unthreaded insulating portion of the frame opening to provide a liquid-tight seal which effectively shields the metal skeleton of the screw, and also isolates the engaged metallic threaded portion of the screw shank from the plating solution and electrical current conducted by it. The portion of the screw to the opposite side of the conductive central portion may also be unthreaded and provided with an electrically insulating covering which sealingly engages with a second unthreaded portion of the frame opening. Preferably, the threaded metallic portion of the screw shank is shorter than the threaded metallic portion of the frame opening ("nut") so that greater shielding from current flow is provided, and so that the metallic screw threads do not cut into the unthreaded insulating portion or portions of the frame opening which adjoin the said metallic nut, and which cooperate with the axial insulating sleeve or sleeves of the screw to effect the seal. Since the threaded metallic interior of the nut would therefore have a length somewhat longer than that of the metallic threaded portion of the screw which would not be engaged, it might retain some electrolytic solution when the clamp is immersed in the electroplating solution, and this could result in some limited leakage and/or entrapment of solution. However, such leakage and/or entrapment is minimal and in most cases may be tolerated, especially in view of the saving in cost of making the improved screw and the possibly more effective sealing action and reduced plating solution build-up between the front and rear end portions of the clamp frame opening and the clamp screw.

The liquid-tight and electrolytic current field seal achieved by the present invention is thus effected by engagement of an unthreaded insulating portion of the screw shank with a surrounding cylindrical unthreaded insulating wall at the frame opening. The dimensions and/or the shapes of the shank portion and wall respectively, are such that a surface-to-surface substantially liquid-tight interference fit is provided over an axially extended zone. Preferably, at least one of the said interfering pieces possesses sufficient resiliency so that a compressive seal is effected where the face-to-face zone contact occurs. The compressive surface-to-surface interference seal is preferably thus provided at at least the forward end of the screw shank. More preferably, such a sealing arrangement is used at both ends of the shank. Although not so preferable, it is also within the province of the invention for the compressive surface-to-surface interference seal to be provided at only one end of the said shank, with a thread-to-thread seal (as in the inventor's U.S. Pat. No. 4,176,039) being used at the opposed end of the shank.

In further accordance with the present invention, instead of providing a clamp pad opposite to the clamp screw which is exposed and extends outwardly from the frame insulating material, I provide a pin surrounded by an insulating sleeve, both of which are flush with the surface of the frame insulating material surrounding the body of the clamp.

Thus, it can be seen that a more positive workpiece clamp pad can be provided to hold the workpiece firmly in place as well as providing a more effective and durable sealing action and reduced plating build-up at the clamp pad opposite to the clamp screw.

It is also possible for the surface-to-surface substantially liquid-tight interference fit to be achieved by very accurate machining or other forming of the interfering surfaces.

An object of the invention is accordingly to provide an improved clamp for securing and electrically connecting an item to be electroplated to an electroplating rack for immersion in an electroplating solution.

A further object of the invention is to simplify and reduce the cost of a clamp for securing and electrically connecting an item to be electroplated to an electroplating rack for immersion in an electroplating solution.

Another object of the invention is to provide a clamp having the above-noted features, yet with possibly improved sealing and reduced plating build-up characteristics.

These and further objects of the invention will appear as the specification progresses. The invention will be described in detail in connection with a preferred embodiment. However, other modifications will be apparent to those skilled in this art. Thus, the invention is defined, and its novel features are pointed out in the appended claims.

DESCRIPTION OF THE DRAWING

FIG. 1 is a front elevational view of an electroplating rack using a clamp according to the invention, the features depicted in such drawing corresponding as will to the prior art;

FIG. 2A is a side sectional view of the prior art clamp disclosed in the inventor's U.S. Pat. No. 4,176,039, for use in an electroplating rack as shown in FIG. 1;

DETAILED DESCRIPTION OF PREFERRED EMBODIMENTS

Figure 2B:
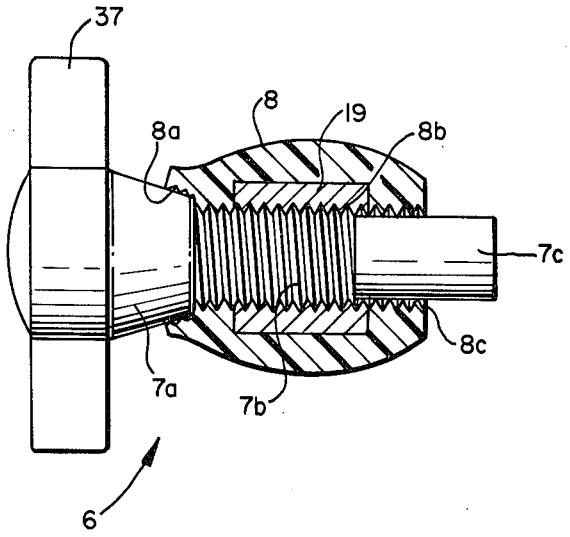
Fig. 2B (PRIOR ART)
FIG. 2B is a partial side sectional view of another prior art clamp developed by the inventor, for use in an electroplating rack as shown in FIG. 1.

As shown in FIG. 1 of the drawings, an electroplating rack 15 is suspended from a cross-bar 53 by a bracket 11 and extends downwardly into a bath of electroplating solution 25. Items 21 to be plated, which may be, for example, circuit boards (FIG. 2A) which comprise conductive sheets 21*a* and 21*b* and a central insulator 21*c*, are secured to rack 15 by clamp assemblies 13 and are immersed in the plating solution.

The clamp 9 is of the type disclosed in the inventor's U.S. Pat. No. 4,176,039, and is shown in detail in FIG. 2A. Such clamps are located at longitudinally-spaced locations along the rack 15. Clamp 9 includes a clamp frame 9 which has a threaded opening which includes a conductive nut 19. A threaded thumb screw extends into the opening of frame 8. The central core of the screw is conductive. Externally, the screw includes two end portions 51*a* and 51*c* which are covered with a resilient insulating material, while center section 51*b* is contiguous with the conductive core and electrically exposed to engage the internal threads of conductive nut 19. Each clamp screw has an actuating head in the form of actuating handle 37. The threaded shank 51*a*, 51*b*, and 51*c*, extends from the handle 37, and terminates in a clamp face 45 which is the electrically uninsulated distal end of the conductive core of the clamp screw.

The item 21 to be electroplated is held between the clamp face 45 and a boss 29 on a clamp pad 41 connected to the conductive core 17 of the clamp.

The entire clamp frame 8 is covered with an electrically insulating material 23, which may be of a type discussed in the inventor's U.S. Pat. No. 4,176,039.

The clamp 6 developed by the inventor and shown in detail in FIG. 2B is of a similar type to the clamp 9 discussed above, and as shown in FIGS. 1 and 2A. However, the clamp 6, instead of having a screw with two threaded end portions 51*a* and 51*c*, has a front end portion 7*c* extending from a front threaded end opening in the frame 8 toward the item 21 to be electroplated. A rear conical shaped end portion 7*a* of the screw shank is provided for connecting a central threaded section 7*b* of the screw shank threadably engaging the central threaded portion 8b of the frame opening and a handle 37 for the clamp, the rear end portion 7a engaging a rear threaded end opening 8a of the frame 8.

Figure 3:
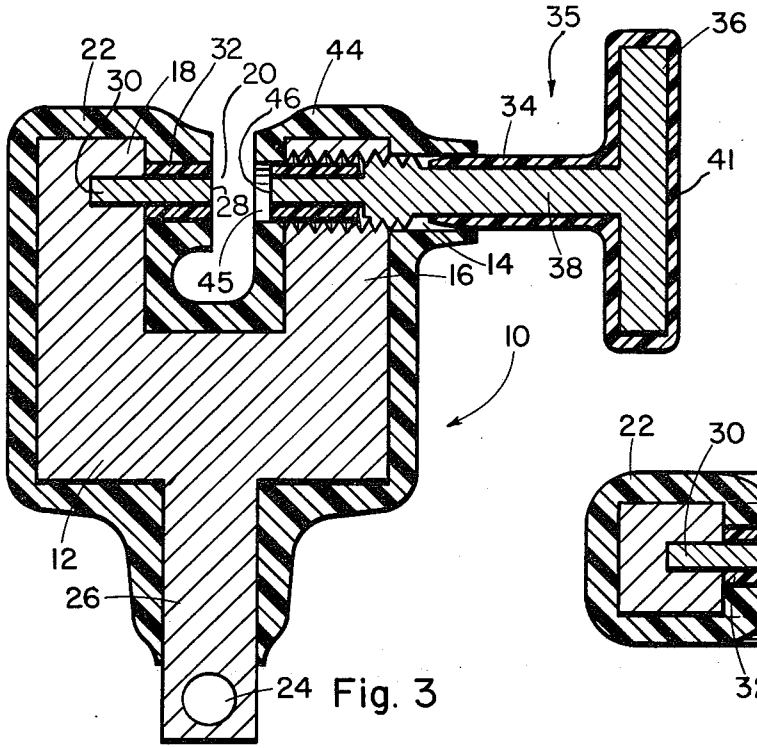
FIG. 3 is a plan view in section of a clamp for use in an electroplating rack according to the present invention, with the thumb screw partially inserted into the clamp.

Referring now to FIG. 3, the clamp 10, according to the present invention, includes a generally U-shaped body 12 made of a conductive material, and having an aperture 14 in the end of one of the legs 16. Leg 16 together with the other leg 18 define a transverse opening 20 for receiving a workpiece (not shown). The external surface of clamp 10 is also covered with an insulating material 22, except for a terminal 24 formed by an aperture in an extension 26 of the side of the U-shaped body. This insulating material may be a synthetic resin material that is inert to the plating liquid of the electroplating bath. Examples of such insulating material are given in the inventor's U.S. Pat. No. 4,176,039.

Figure 5:
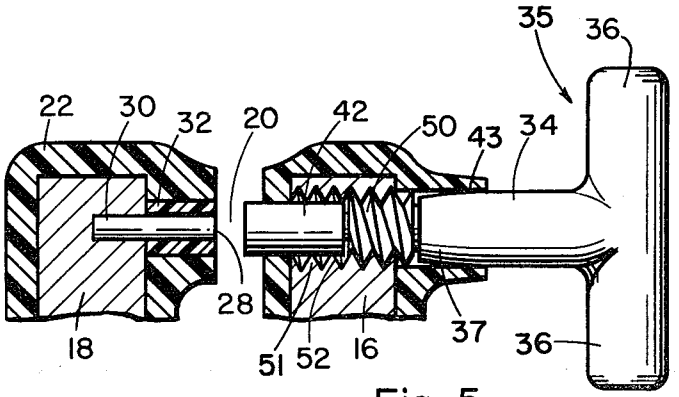
FIG. 5 is a top view, partly in perspective and partly in section of the clamp of FIG. 3, showing the thumb screw almost fully inserted for engaging an object to be electroplated.
Figure 4:
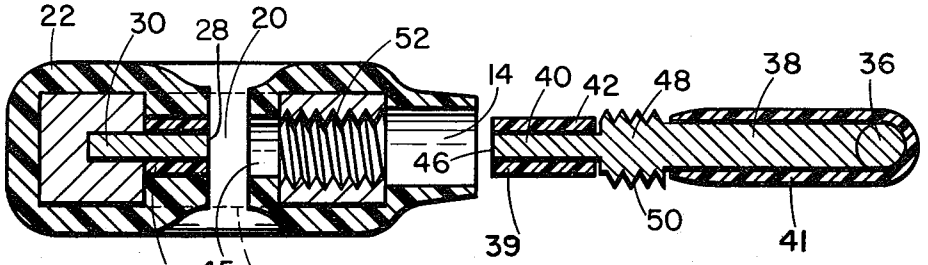
FIG. 4 is a side view in section of the clamp of FIG. 3, with the thumb screw withdrawn from the clamp body.

The leg 18 of the clamp is provided with a clamp pad 28 (FIGS. 3–5) which comprises a central conductive pin 30 which, at one end is embedded in the conductive body 12. Pin 30 is surrounded by a sleeve 32 of insulating material, which seals the pin and prevents the bath liquid from reaching the conductive body 12. The distal end of the pin is flush with the surface of the insulating material fully surrounding the rest of the pin 30 and sleeve 32, and the body 12 and constitutes a pad against which the workpiece can can be clamped, or held in place.

The other leg 16, as noted previously, is provided with an aperture 14 for receiving a thumb-screw 35 which has a handle 36 for turning the screw in the aperture. The rearward portion 34 of thumb-screw 35, including handle 36, is covered with an insulating material 41. Material 41 like that covering the clamp, may comprise a plastisol such as that disclosed in the inventor's U.S. Pat. No. 4,176,039, and possesses a degree of resiliency.

The end portion 39 of thumb-screw 35 remote from handle 36 has a portion 40 of diameter which is reduced in comparison to the remainder of the screw core, and which is covered with a sleeve 42 of a resilient insulating material. The portion 44 of the insulating covering 22 which fits over the end of leg 16 has an aperture 45 through which the screw portion 39 can extend; the sleeve 42 fits snuggly with this aperture to provide an effective liquid-tight surface-to-surface interference seal of the type heretofore discussed. As an insulating material for sleeve 42, I prefer to use a PTFE type plastic such as Teflon®. The end 46 of the screw conductive core is exposed to contact the workpiece, which can be clamped between this end and the clamping pad 28.

The central portion 48 of the screw core is provided with threads 50 that are not covered with insulating material. These threads of the screw shank mate with threads 52 in the opening 51 of the conductive core of leg 16 to form a conductive connection between the workpiece and the conductive core. The threaded portion in the leg 16, therefore, constitutes a nut which engages the thumb screw.

Sleeve 42 thus serves as a shield to prevent plate built-up on this portion of the screw, and as a compressive seal which prevents the electrolytic solution and the flow of electricity conducted by it from entering and reaching the uncovered threads of the screw, or those of the nut, which would deleteriously effect same by permitting plate build-up to jam the system, entrap solutions which could contaminate subsequent solution in the plating cycle, and which can attack the metal plate in question.

The relatively resilient insulating material 41 which covers the rearward portion 34 of screw 35, is seen to similarly engage in snug interfitting fashion with the opening 43 in material 22 which adjoins opening 51 of the conductive body 12. The diameter of portion 34 is such that it mates with opening 43 to effect a seal which satisfactorily retards liquid and electrolytic current flow at this interface. Such seal is again effected because of the surface-to-surface interference fit—in this instance between portion 34 and the adjacent unthreaded wall of opening 43. Although material 41 is in this instance resilient, the material 41 could be relatively rigid, with the adjacent wall of opening 43 instead, comprising a relatively resilient material.

As previously mentioned, it is also within the province of the invention for the rearward portion of screw 35 to be covered with a threaded resilient insulating material, as in the inventor's U.S. Pat. No. 4,176,039. In this instance, the opening 43 would be provided with mating screw threads.

Preferably, the threaded interior of the nut has a length somewhat longer than that of the threaded portion of the thumb screw, whereby a few threads are present at the front and rear of the nut, which will not be engaged in use by the thumb screw. These portions accordingly can retain some electrolytic solution which may result in some limited leakage, but such leakage in most applications is inconsequential, and is off-set by the lower cost of the screw.

It will thus be seen that in order to secure a workpiece for electroplating, it is placed between the legs 16 and 18, which form jaws of a clamp. The thumb-screw 34 is moved transversely, i.e. by turning handle 36, which turns the screw until the threads engage those of the nut. Continued rotation of the handle moves the screw transversely until it engages the workpiece holding it securely between the end 39 of the screw and the clamp rod 28. A conductive connection is made through the clamp pad and the screw by means of the exposed threads which contact the threads of the nut. As noted above, if there is any leakage, it is inconsequential in most applications. In any case, the cost of the screw, which requires only a central threaded portion of limited length, is far lower than the tripartite screw shown in U.S. Pat. No. 4,176,039, yet produces a comparable—and possibly superior—sealing action. Moreover, the clamp pad 28 is configured to improve the clamping and sealing actions, to make the system more durable, and to reduce plating build-up.

It will be apparent to those skilled in the art that other modifications could also be made. Therefore, while the foregoing description is that of a preferred embodiment, the invention is not limited in detail to the foregoing embodiment, but is defined in the following claims.

What is claimed is:

1. A clamp for securing and electrically connecting an object to be electroplated to an electroplating rack for immersion in an electroplating solution, electrical contact being made between the rack and the object, said clamp comprising:

(a) a frame including a core of conductive material and a sheath of insulating material covering the core, said core being connectable to the rack for connecting the frame to a source of electrical current;

(b) an opening in the frame having a threaded electrically conductive portion extending through a portion of the core, and having at least one unthreaded electrically insulating end portion;

(c) a clamp screw having an actuating head, a clamp face, and a threaded central electrically conductive shank portion intermediate the clamp face and actuating head and spaced therefrom, the threaded electrically conductive shank portion being adapted to engage the threaded electrically conductive core portion of said frame opening, said screw having at least one shank portion contiguous with and flanking said central shank portion which is unthreaded, said at least one unthreaded shank portion and said at least one unthreaded end portion of the frame opening facing each other and being dimensioned for a surface-to-surface substantially liquid-tight interference fit, to provide therebetween a relatively liquid-tight seal, the clamp face including a conductive face portion for contacting the item to be electroplated, the conductive face portion being conductively interconnected with the threaded shank portion; and (d) clamping pad means on the frame opposite the clamp face to said clamp screw for enabling the item to be electrically engaged and clamped between the clamp screw and said clamping means.

2. A clamp for securing and electrically connecting an object to be electroplated to an electroplating rack for immersion in an electroplating solution, electrical contact being made between the rack and the object, said clamp comprising:

(a) a frame including a core of conductive material and a sheath of insulating material covering the core, said core being connectable to the rack for connecting the frame to a source of electrical current;

(b) an opening in the frame having a threaded electrically conductive portion extending through a portion of the core, and having at least one unthreaded electrically insulating end portion;

(c) a clamp screw having an actuating head, a clamp face, and a threaded central electrically conductive shank portion intermediate the clamp face and actuating head and spaced therefrom, the threaded electrically conductive shank portion being adapted to engage the threaded electrically conductive core portion of said frame opening, said screw having at least one shank portion contiguous with and flanking said central shank portion which is unthreaded, said at least one unthreaded shank portion and said at least one unthreaded end portion of the frame opening facing each other and being dimensioned for a surface-to-surface substantially liquid-tight interference fit, to provide therebetween a relatively liquid-tight seal, the clamp face including a conductive face portion for contacting the item to be electroplated, the conductive face portion being conductively interconnected with the threaded shank portion and wherein said unthreaded screw shank portion or said corresponding unthreaded end portion of the frame opening is covered with an insulating material; and (d) clamping pad means on the frame opposite the clamp face of said clamp screw for enabling the item to be electrically engaged and clamped between the clamp screw and said clamping means.

3. A clamp in accordance with claim 1 or 2, wherein the shank portion of said screw extending between the end of said threaded electrically conductive shank portion and the clamp face, is unthreaded and sealingly engages in said interference seal with the unthreaded end portion of said frame opening when said screw is mounted in said frame to clamp the object to be electroplated.

4. A clamp in accordance with claim 1 or 2, wherein the shank portions of said screw to both sides of said threaded electrically conductive central shank portion are unthreaded and covered with an insulating material, and wherein the frame opening has unthreaded portions to alternate sides of the threaded conductive cone portion thereof, the unthreaded shank portions of said screw sealingly engaging with the unthreaded end portions of said frame opening to effect liquid-tight seals to alternate sides of the threaded portion of the frame opening which is engaged with the threaded shank portion of said screw.

5. A clamp as claimed in claim 1 or 2, wherein the threaded central shank portion of the screw is equal to or shorter than the threaded core portion of the frame opening.

6. A clamp as claimed in claim 2, in which an insulating material covers the unthreaded end portion of the frame opening.

7. A clamp as claimed in claim 2, in which an insulating material covers the unthreaded portion of said screw shank.

8. A clamp as claimed in claim 6, wherein an insulating material covers the unthreaded portion of said screw shank.

9. A clamp as claimed in claim 3, wherein a PFTE-type plastic insulating material covers the shank portion of said screw extending between the end of said threaded electrically conductive portion of said shank and said clamp face.

10. A clamp as claimed in claim 1 or 2, wherein said clamping pad means comprises a clamp face opposite the clamp face of the clamp screw for enabling the object to be clamped therebetween, the face of the clamping pad means including a conductive surface for engaging the object, conductive means interconnecting the conductive surface with the core of the frame, and wherein the insulating sheath of the frame surrounds the clamping pad means with the clamp face of the clamping pad means being positioned substantially flush with the surrounding frame sheath, to provided therebetween a liquid-tight seal.

11. A clamp as claimed in claim 10, wherein said conductive means of the clamping pad means comprises a pin having one end embedded in the core of the frame and another end forming a flat clamp face conductive surface.

12. A clamp as claimed in claim 11, further comprising a sleeve of additional insulating material extending around the pin, axially inwardly to the core of the clamp frame and axially outwardly to the end conductive surface of the pin, the sleeve being surrounded by the insulating sheath of the frame with the outwardly extending end of the sleeve positioned flush with the surrounding frame sheath and forming a portion of the clamp face of the clamping pad means with the end conductive surface of the pin.

13. A clamp for securing and electrically connecting an object to be electroplated to an electroplating rack for immersion in an electroplating solution, electrical contact being made between the rack and the object, the clamp comprising:

(a) a clamp frame including a core of conductive material connectable to the rack, a sheath of insulating material covering the core and an opening in the frame with a threaded electrically conductive portion extending through a portion of the core;

(b) a clamp screw having a clamp face, an actuating head and a threaded central electrically conductive shank portion intermediate the clamp face and actuating head for engaging the threaded electrically conductive portion of said frame opening, and the clamp face including a conductive surface for contacting the item to be electroplated, the clamp face conductive surface being conductively interconnected with the threaded shank portion; and (c) clamping pad means having (i) a clamp face opposite the clamp face of the clamp screw for enabling the object to be clamped between the clamp faces, the face of the clamping pad means including a conductive surface for engaging the object, (ii) conductive means for interconnecting the conductive surface with the core of the frame, including a pin having one end embedded in the core of the frame and another end forming a flat clamp face conductive surface, and (iii) a sleeve of additional insulating material extending around the pin, axially inwardly to the core of the clamp frame and axially outwardly to the end conductive surface of the pin, and wherein the frame sheath of insulating material covering the core surrounds the clamp face, conductive means, and insulating sheath, the outwardly extending end of the sleeve positioned flush with the surrounding frame sheath and forming a portion of the clamp face of the clamping pad means with the end conductive surface of the pin, the clamp face formed being positioned substantially flush with the surrounding frame sheath, to provide therebetween a liquid-tight seal.

14. A clamp as claimed in claim 13, wherein said opening in the frame has at least one unthreaded electrically insulating end portion facing the clamp face of the clamping pad means, and wherein the clamp screw has at least one unthreaded shank portion contiguous with and flanking the central threaded shank portion, the unthreaded screw shank portion and the unthreaded end portion of the frame opening being dimensioned for a surface-to-surface substantially-liquid tight fit, to provide therebetween a liquid-tight seal for the clamp face of the clamp screw.

15. A clamp as claimed in claim 14, wherein shank portions of said clamp screw to both sides of the threaded electrically-conductive central shank portion are unthreaded and covered with an insulating material, and wherein the frame opening has unthreaded end portions to alternate sides of the threaded portion thereof, with the unthreaded portions of the screw shank sealingly engaging with the unthreaded end portions of the frame opening to effect liquid-tight seals to alternate sides of the threaded portion of the frame opening which is engaged with the threaded shank portion of the screw.

16. A clamp for securing and electrically connecting an object to be electroplated to an electroplating rack for immersion in an electroplating solution, electrical contact being made between the rack and the object, the clamp comprising:

(a) a clamp frame including a core of conductive material connectable to the rack, a sheath of insulating material covering the core and an opening in the frame with a threaded electrically conductive portion extending through a portion of the core;

(b) a clamp screw having a clamp face, an actuating head and a threaded central electrically conductive shank portion intermediate the clamp face and actuating head for engaging the threaded electrically conductive portion of said frame opening, and the clamp face including a conductive surface for contacting the item to be electroplated, the clamp face conductive surface being conductively interconnected with the threaded shank portion; and (c) clamping pad means having (i) a clamp face opposite the clamp face of the clamp screw for enabling the object to be clamped between the clamp faces, the face of the clamping pad means including a conductive surface for engaging the object, and (ii) conductive means for interconnecting the conductive surface with the core of the frame, and wherein the frame sheath of insulating material covering the core surrounds the clamp face and conductive means, with the clamp face being positioned substantially flush with the surrounding frame sheath, to provide therebetween a liquid-tight seal; and wherein said opening in the frame has at least one unthreaded electrically insulating end portion facing the clamp face of the clamping pad means, and the clamp screw has at least one unthreaded shank portion contiguous with and flanking the central threaded shank portion, the unthreaded screw shank portion and the unthreaded end portion of the frame opening being dimensioned for a surface-to-surface substantially-liquid tight fit, to provide therebetween a liquid-tight seal for the clamp face of the clamp screw.

17. A clamp for securing and electrically connecting an object to be electroplated to an electroplating rack for immersion in an electroplating solution, electrical contact being made between the rack and the object, the clamp comprising:

(a) a clamp frame including a core of conductive material connectable to the rack, a sheath of insulating material covering the core and an opening in the frame with a threaded electrically conductive portion extending through a portion of the core;

(b) a clamp screw having a clamp face, an actuating head and a threaded central electrically conductive shank portion intermediate the clamp face and actuating head for engaging the threaded electrically conductive portion of said frame opening, and the clamp face including a conductive surface for contacting the item to be electroplated, the clamp face conductive surface being conductively interconnected with the threaded shank portion; and (c) clamping pad means having (i) a clamp face opposite the clamp face of the clamp screw for enabling the object to be clamped between the clamp faces, the face of the clamping pad means including a conductive surface for engaging the object, and (ii) conductive means for interconnecting the conductive surface with the core of the frame, including a pin having one end embedded in the core of the frame and another end forming a flat clamp face conductor surface, and wherein the frame sheath of insulating material covering the core surrounds the clamp face and conductive means, with the clamp face being positioned substantially flush with the surrounding frame sheath, to provide therebetween a liquid-tight seal; and wherein said opening in the frame has at least one unthreaded electrically insulating end portion facing the clamp face of the clamping pad means, and the clamp screw has at least one unthreaded shank portion contiguous with and flanking the central threaded shank portion, the unthreaded screw shank portion and the unthreaded end portion of the frame opening being dimensioned for a surface-to-surface substantially-liquid tight fit, to provide therebetween a liquid-tight seal for the clamp face of the clamp screw.

18. A clamp for securing and electrically connecting an object to be electroplated to an electroplating rack for immersion in an electroplating solution, electrical contact being made between the rack and the object, said clamp comprising:

(a) a frame including a core of conductive material and a sheath of insulating material covering the core, said core being connectable to the rack for connecting the frame to a source of electrical current;

(b) an opening in the frame having a threaded electrically conductive portion extending through a portion of the core, and having two unthreaded electrically insulating end portions, the sheath of insulating material of said frame covering the two unthreaded end portions of the frame opening;

(c) a clamp screw having (i) an actuating head, (ii) a clamp face having a conductive face portion for contacting the item to be electroplated, (iii) a threaded central electrically conductive shank portion intermediate the clamp face and actuating head and spaced therefrom, the threaded electrically conductive shank portion being conductively interconnected with the conductive face portion and being adapted to engage the threaded electrically conductive core portion of said frame and the threaded shank portion of the screw being equal to or shorter than the threaded core portion of the frame opening, and (iv) two unthreaded shank portions contiguous with and flanking said central shank portion and covered with an insulating material, the unthreaded shank portions of the clamp screw sealingly engaging with the corresponding unthreaded end portions of said frame opening to effect liquid-tight seals to alternate sides of the threaded portion of the frame opening which is engaged with the threaded shank portion of said screw; and (d) clamping means on the frame opposite the clamp face of said screw for enabling the item to be electrically engaged and clamped between the clamp screw and said clamping pad means, said clamping pad means having (i) a clamp face opposite the clamp face of the clamp screw for enabling the object to be clamped therebetween, the face of the clamping pad means including a conductive surface for engaging the object, and (ii) conductive means for interconnecting the conductive surface with the core of the frame, the conductive means including a connecting pin having one end in the core of the frame and another end forming a flat clamp face conductive surface, and wherein the insulating sheath of the frame surrounds the clamping pad means with the clamp face of the clamping pad means being positioned substantially flush with the surrounding frame sheath, to provide therebetween a liquid-tight seal.

19. A clamp as claimed in claim 18, in which the insulating material covering the unthreaded portion of said screw shank adjacent the screw clamp face is a PFTE-type plastic.

20. A clamp as claimed in claim 18 or 19, wherein the insulating material covering the unthreaded end portions of the frame opening is a plastisol.

* * * * *